US006253501B1

(12) United States Patent
Provitola

(10) Patent No.: US 6,253,501 B1
(45) Date of Patent: Jul. 3, 2001

(54) HORIZONTAL ARCH

(76) Inventor: Anthony Italo Provitola, P.O. Box 2855, DeLand, FL (US) 32721-2855

( * ) Notice: Subject to any disclaimer, the term of this patent is extended or adjusted under 35 U.S.C. 154(b) by 0 days.

(21) Appl. No.: 09/307,985

(22) Filed: May 10, 1999

(51) Int. Cl.[7] ..... E04B 1/08

(52) U.S. Cl. ..... 52/81.1; 52/80.1; 52/578; 52/245; 52/249

(58) Field of Search ..... 52/578, 80.1, 81.1, 52/245, 249

(56) References Cited

U.S. PATENT DOCUMENTS

| | | | | |
|---|---|---|---|---|
| 86,796 | * | 2/1869 | Absterdam | 52/81.1 |
| 2,305,112 | * | 12/1942 | Scott | 52/81.1 |
| 3,192,668 | * | 7/1965 | Grieb | 52/81.1 X |
| 3,197,927 | * | 8/1965 | Fuller | 52/81.1 |
| 3,490,638 | * | 1/1970 | Elliott et al. | 52/81.1 X |
| 4,075,813 | * | 2/1978 | Nalick | 52/81.1 X |
| 4,091,583 | * | 5/1978 | Genis et al. | 52/81 |
| 4,118,904 | | 10/1978 | Sprung . | |
| 4,160,345 | * | 7/1979 | Nalick | 52/81 |
| 4,164,089 | * | 8/1979 | George | 43/1 |
| 4,306,392 | | 12/1981 | SoRelle . | |
| 4,651,478 | * | 3/1987 | Dahl et al. | 52/2 |
| 4,784,172 | * | 11/1988 | Yacoboni | 135/87 |
| 5,394,661 | * | 3/1995 | Noble | 52/81.1 X |
| 5,485,701 | * | 1/1996 | Hecht | 52/80.1 |
| 5,560,151 | * | 10/1996 | Roberts | 52/81.1 |
| 5,715,854 | * | 2/1998 | Andrieux et al. | 135/94 |
| 5,916,097 | * | 6/1999 | Markuten | 52/81.2 |
| 5,950,649 | * | 9/1999 | Gerig | 135/125 |
| 5,970,661 | * | 10/1999 | Bishop et al. | 52/2.11 |
| 6,134,849 | * | 10/2000 | Holler | 52/80.1 |

FOREIGN PATENT DOCUMENTS

| | | | | |
|---|---|---|---|---|
| 1191776 | * | 9/1967 | (FR) | 52/81.1 |
| 57944A | * | 9/1967 | (DE) | 52/81.1 |

* cited by examiner

*Primary Examiner*—Carl D. Friedman
*Assistant Examiner*—Phi Dieu Tran A

(57) ABSTRACT

A horizontal arch is a structural element formed from a series of compression members which are arranged side-to-side in a curve array, and compressed together under the application of loading perpendicular to the plane of the curve of the horizontal arch. The vertically downward loading of the members may also result from structures suspended from the tops of the members of the horizontal arch structure. The object of the invention is to provide a structural element with horizontal cohesiveness for inclusion in self-supporting frameworks for the exterior of structures and exoskeletal structures.

20 Claims, 4 Drawing Sheets

HORIZONTAL ARCH

CROSS-REFERENCE TO RELATED APPLICATIONS

U.S. patent application Ser. Nos. 09/276665 and 09/276666.

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

The present invention is a structural element in which horizontally compressive support of its members against each other results from vertically downward loading on the members.

The prior art that this invention resembles is the structural element known simply as the "arch", embodied in ancient structures as an element known as the "Roman arch", and known medievally as the "Gothic arch". The "arch" thus known is structured vertically and functions vertically, providing vertical self-support and load bearing by compression of its members together along the arc of the arch which lies in a vertical plane. It does not provide horizontal self-support except to the extent of the frictional forces between its members or other mechanical attachment of the members to one another that may prevent horizontal movement. In contrast, the horizontal arch functions to provide vertical support by using the vertically downward load on its members to compress its members horizontally together along an arc which lays in the horizontal plane, and thereby also functions to provide horizontal self-support.

Prior art considerations include some dome structures which may appear to employ a horizontal arch, such as the Pantheon in Rome, Italy. In that case the dome structure is a series of interleaved vertical arches which are radial within the dome. Another similarity in structure exists in the form of the well known arch of some water-restraining dams which are convex to the load of the restrained water. Such dam arches, however, are vertical arches laid horizontally, and bear no vertically downward load from the water restrained.

The present invention is covered generally by class 52, static structures.

BRIEF SUMMARY OF THE INVENTION

The present invention is a structural element formed from a series of compression members which are connected side-to-side in an arc of a curve in the horizontal plane, and compressed together horizontally under the application of downward loading near the top of each of the compression members. The horizontal arch may be employed as a part of various types of vertically layered constructions in which each layer subjects the next layer below to vertically downward loading, such as towers and buildings. The vertically downward loading of the members may also result from structures suspended from near the tops of the members of the horizontal arch structure.

The object of the invention is to provide a structural element with horizontal cohesiveness for inclusion in self-supporting frameworks for the exterior of structures and exoskeletal structures, as well as a general structural alternative to other vertically downward load bearing structures, such as foundations.

DETAILED DESCRIPTION OF THE INVENTION

Figure 3:
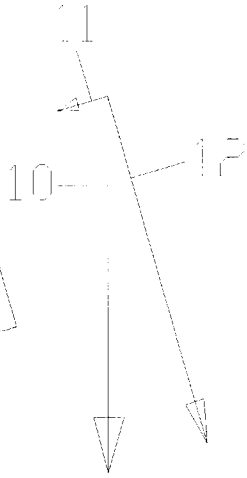
FIG. 3 is a vector diagram of loading forces on the horizontal arch shown in FIG. 1
Figure 6:
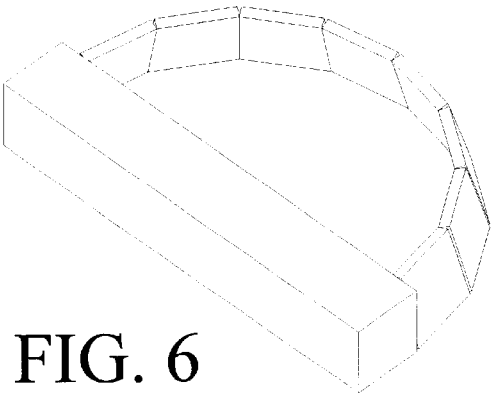
FIG. 6 is a perspective view of the horizontal arch shown in FIG. 1.
Figure 7:
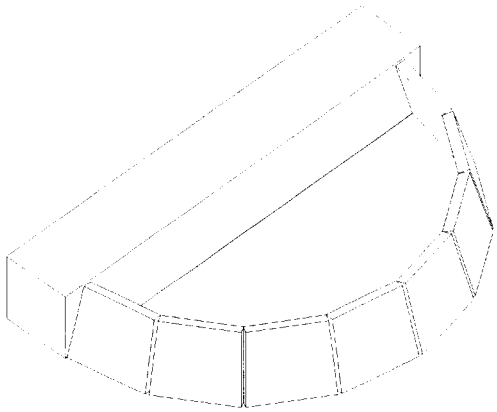
FIG. 7 is a second perspective view of the horizontal arch shown in FIG. 1.

The present invention is horizontal arch, a structural element in which the horizontally compressive support of its members against each other results from the application of vertically downward loading on such members "and such horizontal cohesiveness augments the vertical load bearing of the structural element". The horizontal arch is formed by a plurality of compression members which are connected in a level layer side-to-side, in an unbroken series on or in an arc of a curve in the horizontal plane, with adjacent members leaning together toward the center of curvature of the arc. "The ordinary use of the term 'compression member' is defined in Van Nostrand's Scientific Encyclopedia, Fifth Edition, under 'Compression (Structural)':' . . . A compression member of a structure is subjected to a primary compressive stress . . . '." The positions of the bottom of such compression members are fixed at their base along the horizontal arc which describes the overall shape of the horizontal arch. Said positions are determined by the placement of each compression member so that the sides thereof are in contact, directly, or indirectly within a connection, above and within the perimeter of said arc of the horizontal arch, "i.e. on the side of the arc at which a center of curvature is located for that segment of the arc". The compression members of the horizontal arch are forced together horizontally under the application of vertically downward loading near the top of each of in the same magnitude of the compression members, as demonstrated by the vector diagram in FIG. 3. In FIG. 3 the downward force from the vertical load 10 placed on the top of the horizontal arch resolves into components 11 and 12 with one component 11 drawing the top of the compression member toward the center of curvature of the arch at that point, and the other component 12 parallel to the compression member. The resulting force on each of the compression members from those adjacent to it is compressive horizontally as by the component 11. Thus, the vertical support on the horizontal arch "the top of each compression member is drawn toward the center of the arch". is augmented by the resulting horizontal "cohesiveness of the compression members of the horizontal arch, and the horizontal cohesiveness of the compression members of the horizontal arch is augmented by the vertical loading of the members of the horizontal arch".

Figure 1:
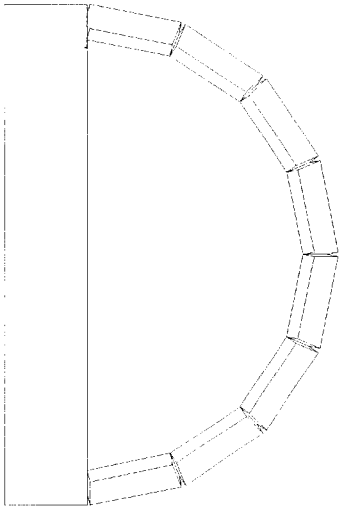
FIG. 1 is a plan view of a semicircular horizontal arch of 8 trapezoidal slab members.
Figure 4:
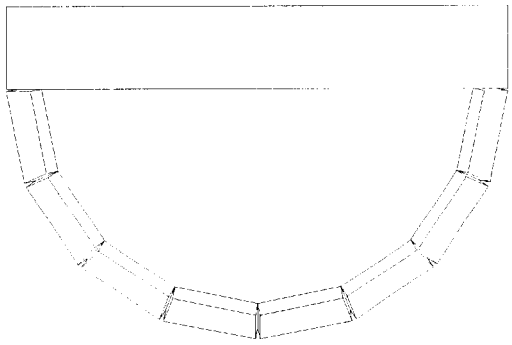
FIG. 4 is a plan view of the horizontal arch shown in FIG. 1 rotated 90 degrees.
Figure 2:
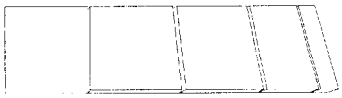
FIG. 2 is a side elevation of the horizontal arch shown in FIG. 1.
Figure 5:
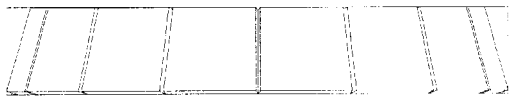
FIG. 5 is a front elevation view of the horizontal arch shown in FIG. 4.

An example of a horizontal arch is shown in FIGS. 1 and 4 "in which the tops of the tops of the compression members comprising the arch lie in a single horizontal plane, and" in which the ends of a horizontal arch of eight planar trapezidal compression members are connected to or otherwise in contact with a second structure, the position of which is also fixed relative to the members of the arch, supporting the ends of the arch as shown in FIGS. 1, 2, 4, 6 and 7.

Figure 8:
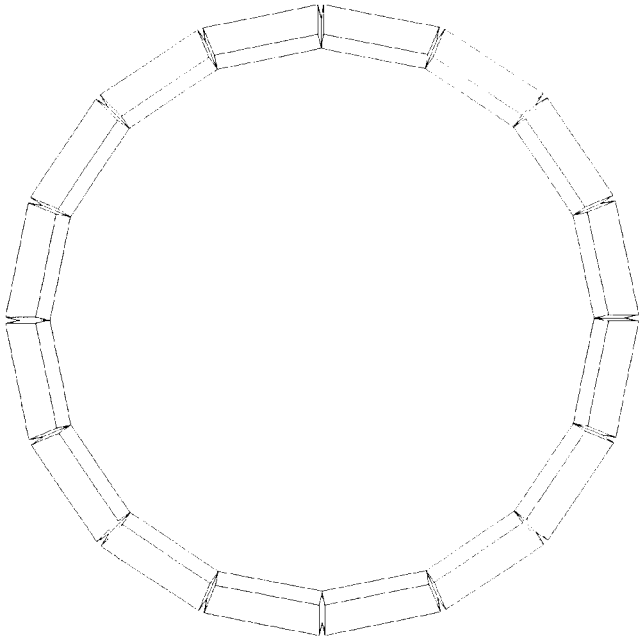
FIG. 8 is a plan view of a circular horizontal arch of 16 trapezoidal slab members.
Figure 9:
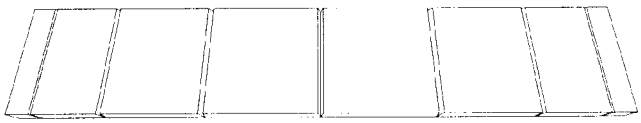
FIG. 9 is a side elevation of the horizontal arch shown in FIG. 8.
Figure 10:
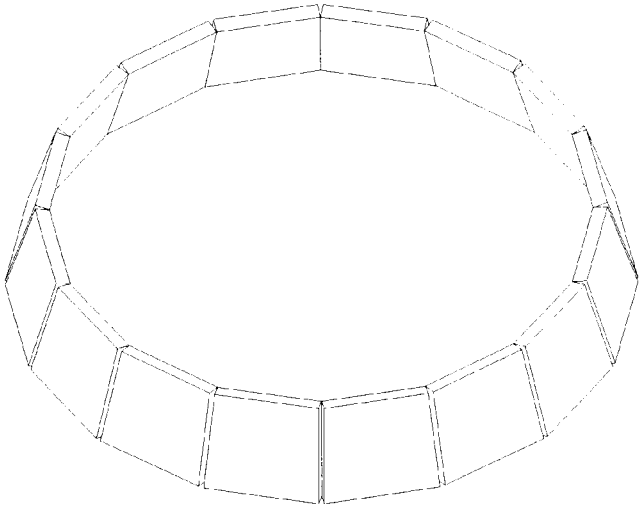
FIG. 10 is a perspective view of the horizontal arch shown in FIG. 8.

The horizontal arch may describe a complete circle as shown in FIGS. 8–10, which can also be viewed as two or more horizontal arches set end-to-end in support of each other, each arch "supporting the other in the role of the second structure showe in FIGS. 1, 2, 4, 6 and 7".

Figure 11:
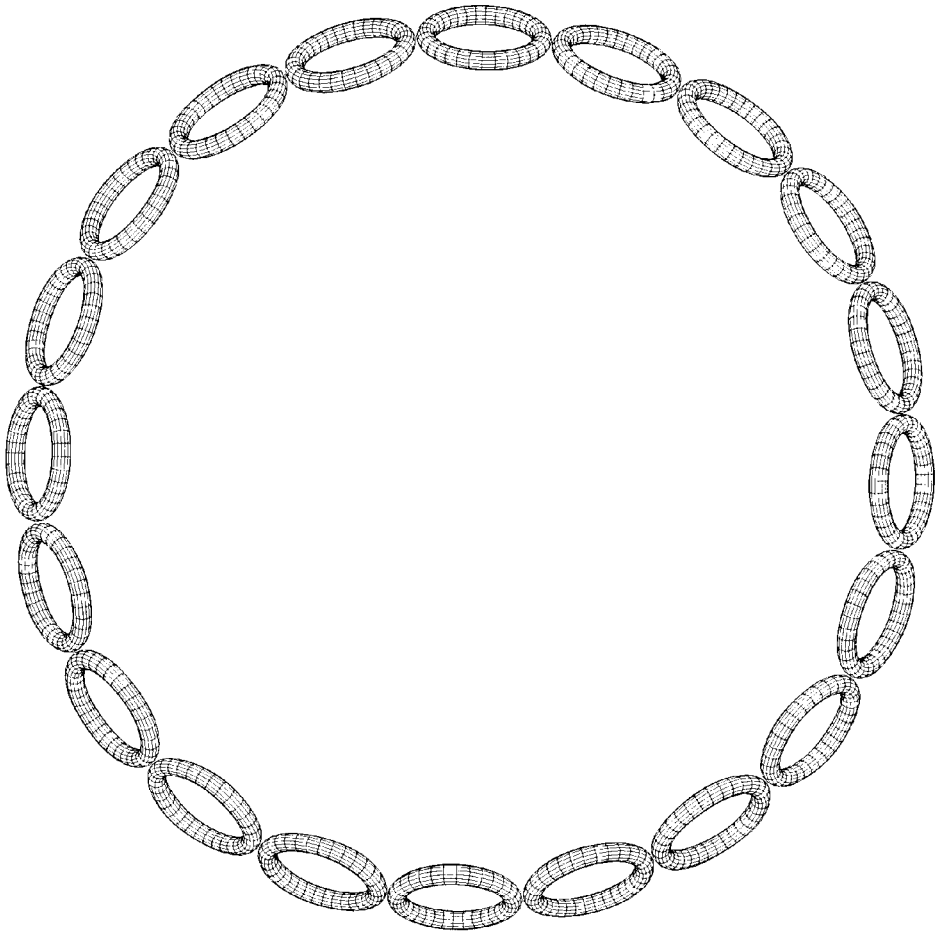
FIG. 11 is a plan view of a circular horizontal arch of 20 toroidal members.
Figure 12:
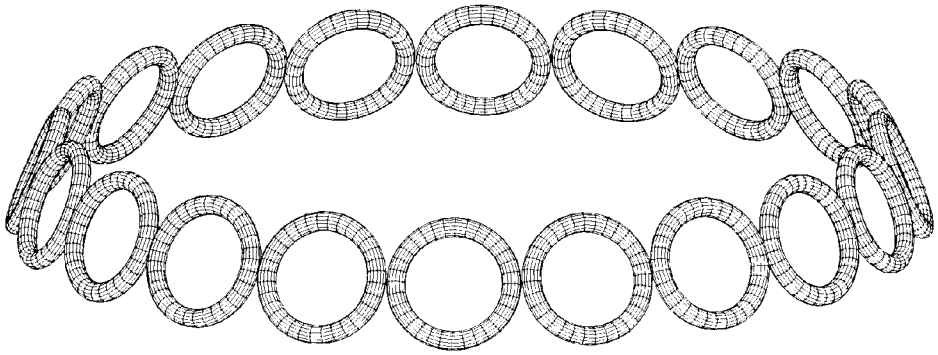
FIG. 12 is a perspective view of the horizontal arch shown in FIG. 11.

Another example of the horizontal arch appears in FIGS. 11 and 12, in which the compression members are toroidal structures connected near where they are proximate to one another as contemplated in U.S. patent application Ser. No. 09/276665, Structural System of Toroidal Elements and Method of Construction Therewith, made by the present applicant. Such toroidal members can have the compression strength and resilience of torsion structures contemplated in U.S. patent application Ser. No. 09/276666, Structural System of Torsion Elements and Method of Construction Therewith, also made by the present applicant, the teachings of which are hereby incorporated by reference for this purpose. For the purposes of supporting the compression load to which such toroidal elements may be subjected, construction with torsion elements as taught in application Ser. No. 09/276666 is the preferred construction.

Figure 13:
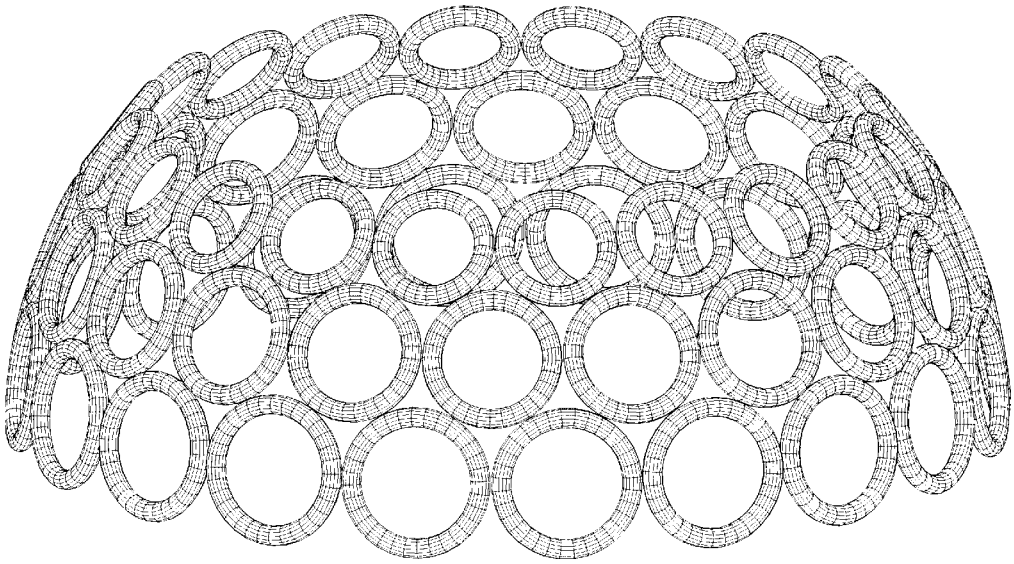
FIG. 13 is a perspective view of a structure formed from three interleaved layers of circular horizontal arches, as shown in FIG. 12.
Figure 14:
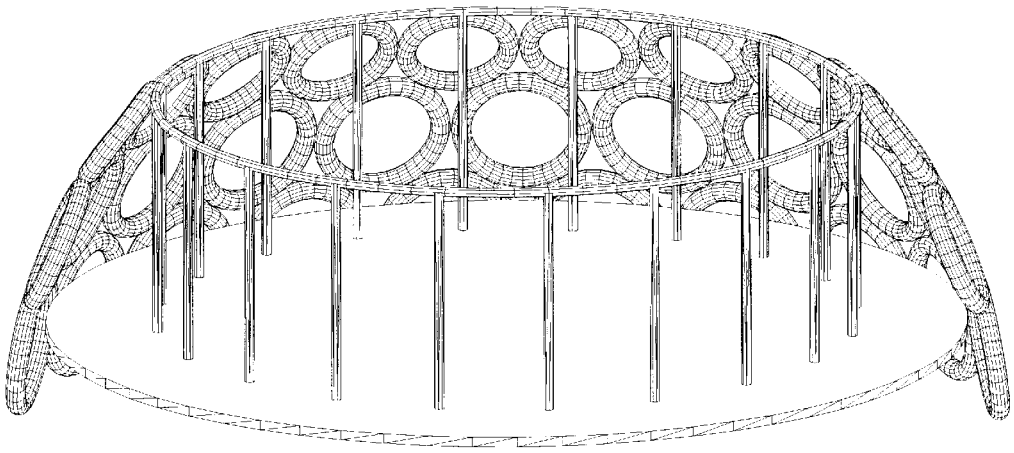
FIG. 14 is a cutaway perspective view of a suspended deck structure incorporated within the structure shown in FIG. 13.

The horizontal arch may be employed as a part of layered constructions as exemplified in FIG. 13, in which each layer subjects the next layer below to vertically downward loading, such as in towers and multi-story buildings. Thus occurs the forcing together of adjacent compression members in each layer and the horizontal cohesiveness of the structure. Vertically downward loads on the compression members of a horizontal arch may also result from structures suspended from near the tops of the members, as shown in the example of FIG. 14, a suspended deck structure. (Suspended deck structures are the subject of a U.S. patent application Ser. No. 09/310,708 by the present applicant.)

An object of the invention is to provide a structural element with horizontal cohesiveness for inclusion in self-supporting frameworks for the exterior of structures and exoskeletal structures. With the horizontal structural cohesiveness contemplated by the present invention, such a framework can support the interior of the structure as well, as in the case of exoskeletal structures exemplified in FIG. 14.

While the invention has been disclosed in connection with a preferred embodiment, it will be understood that there is no intention to limit the invention to the particular embodiment shown, but it is intended to cover the various alternative and equivalent constructions included within the spirit and scope of the appended claims.

What I claim as my invention is:

1. A structural element comprising a plurality of compression members which are toroidal in shape, each of said compression members having two sides, a first half, and a second half diametrically opposite the first half, said compression members being arranged on a surface, side-to-side, in a curved array, with the second half of each of said compression members being on said surface and being fixed in position, and each of said compression members being tilted into the curve of said curved array, said curve being a single curve without any reverse; wherein the positions of said first halves of each of said compression member in said curved array lie substantially in a plane; so that said compression members are forced together by the application of a load, in a direction perpendicular to the plane of the curve of said curved array, on the first half of each of said compression members, whereby said curved array of compression members coheres as a structural element for bearing said load.

2. The structural element of claim 1 wherein the curve of said curved array is a closed curve.

3. The structural element of claim 1 wherein each of said compression members are connected to an adjacent compression member.

4. The structural element of claim 1 wherein the surface on which said compression members are arranged is a plane.

5. The structural element of claim 1 wherein the compression members at the termini of said curved array are fixed structures.

6. The structural element of claim 1 wherein the sides of the adjacent compression members are in contact.

7. A structural element of comprising a plurality of toroidally shaped compression members, each of said compression members having two sides, first end, and a second end diametrically opposite the first end, said compression members being arranged on a surface, side-to-side, in a curved array, with the second end of each of said compression members being on said surface and being fixed in position, and each of said compression members being tilted into the curve of said curved array, said curve being a single curve without any reverse; wherein the positions of said first ends of each of said compression member in said curved array lie substantially in a plane; so that said compression members are forced together by the application of a load, in a direction perpendicular to the plane of the curve of said curved array, at the first end of each of said compression members, whereby said curved array of compression members coheres as a structural element for bearing said load.

8. The structural element of claim 7 wherein each of said compression members are connected to an adjacent compression member.

9. The structural element of claim 7 wherein the surface on which said compression members are arranged is a plane.

10. The structural element of claim 7 wherein the curve of said curved array is a closed curve.

11. The structural element of claim 7 wherein the compression members at the termini of said curved array are fixed structures.

12. The structural element of claim 7 wherein the magnitude of the load on each compression member is substantially the same for all of the compression members.

13. The structural element of claim 7 wherein the structure of said compression members is substantially the same.

14. A structural element comprising a plurality of toroidally shaped compression members, each of said compression members having two sides, a first end, and a second end diametrically opposite the first end, said compression members being arranged on a surface side-to-side, in a curved array with the second end of each of said compression members being on said surface and being fixed in position, and each of said compression members being tilted into the curve of said curved array, said curve being a single curve without any reverse; so that said compression members are forced together by the application of a load, in a direction perpendicular to the plane of the curve of said curved array, at the first end of each of said compression members, whereby said curved array of compression members coheres as a structural element for bearing said load.

15. The structural element of claim 14 wherein each of said compression members are connected to adjacent compression member.

16. The structural element of claim 14 wherein the surface on which said compression members are arranged is a plane.

17. The structural element of claim 14 wherein the curve of said curved array is a closed curve.

18. The structural element of claim 14 wherein the positions of said first ends of each of said compression member in said curved array lie in a plane.

19. The structural element of claim 14 wherein the magnitude of the load on each compression member is substantially the same for all of the compression members.

20. The structural element of claim 14 wherein the structure of said compression members is substantially the same.

* * * * *